United States Patent [19]

Pearson

[11] 4,433,823

[45] Feb. 28, 1984

[54] DRINK COASTERS

[76] Inventor: Mark Pearson, 15 Rae St., East Bentleigh. 3165, Melbourne, Victoria, Australia

[21] Appl. No.: 227,347

[22] Filed: Jan. 22, 1981

[51] Int. Cl.[3] ..... A47G 23/03

[52] U.S. Cl. ..... 248/346.1

[58] Field of Search ..... 248/346.1; 75/222

[56] References Cited

U.S. PATENT DOCUMENTS

| | | | |
|---|---|---|---|
| 508,140 | 11/1893 | Koch | 248/346.1 |
| 718,517 | 1/1903 | Perry | 248/346.1 |
| 1,971,337 | 8/1934 | Collins | 248/346.1 |
| 2,182,741 | 12/1939 | Bolesky et al. | 75/222 X |
| 2,554,343 | 5/1951 | Pall . | |
| 2,595,961 | 5/1952 | Layne . | |
| 2,652,703 | 9/1953 | Keegan | 248/346.1 |
| 2,709,905 | 6/1955 | Dunlap | 248/346.1 |
| 2,765,728 | 10/1956 | Pearce . | |
| 2,826,805 | 3/1958 | Probst et al. | 75/222 X |
| 3,195,847 | 7/1965 | Squires | 248/346.1 |
| 4,206,570 | 6/1980 | Cooper . | |
| 4,298,579 | 11/1981 | Kuhn | 423/11 |

FOREIGN PATENT DOCUMENTS

| | | |
|---|---|---|
| 75530 | 1/1893 | Fed. Rep. of Germany . |
| 280804 | 12/1913 | Fed. Rep. of Germany . |
| 381719 | 11/1907 | France . |
| 2424086 | 4/1978 | France . |
| 7005774 | 10/1970 | Netherlands . |

*Primary Examiner*—Ramon S. Britts
*Assistant Examiner*—Sarah A. Lechok
*Attorney, Agent, or Firm*—Cushman, Darby & Cushman

[57] ABSTRACT

The present invention provides a coaster for a drink container characterized in that the coaster incorporates a microporous structure capable of absorbing liquids which fall upon the surface thereof. Such a coaster, provided it is of appropriate dimensions and porosity, can prevent any spillage or condensation from reaching the table surface, yet will remain externally dry.

5 Claims, 4 Drawing Figures

Fig. 1
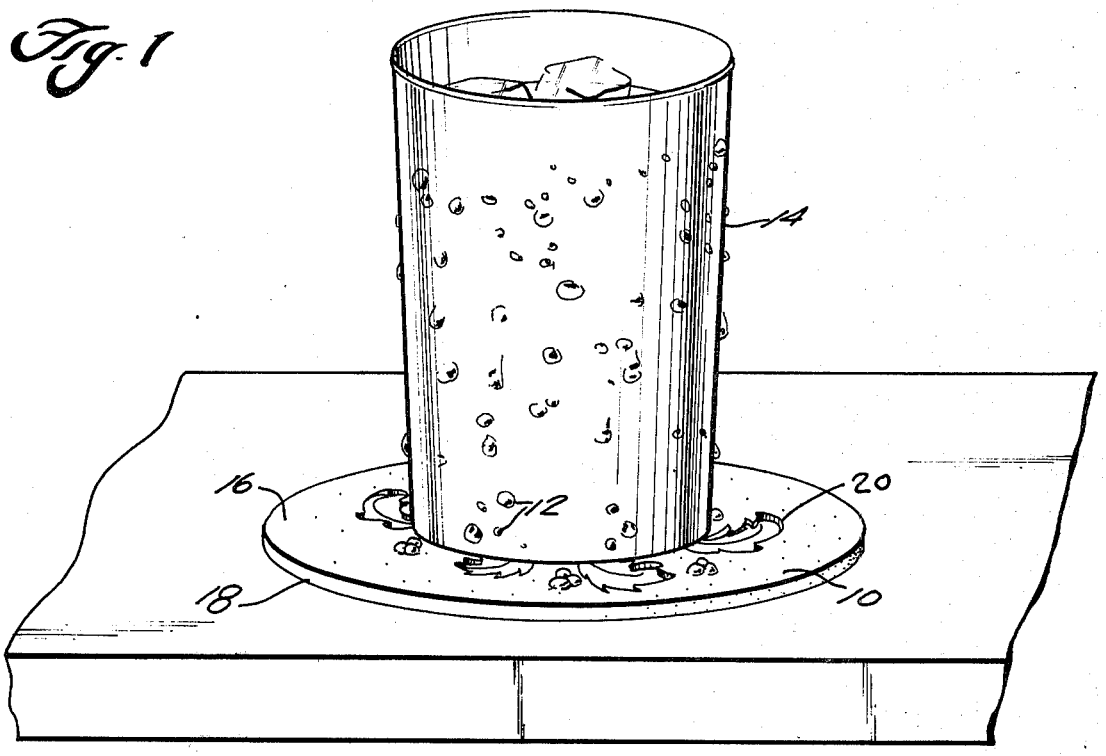
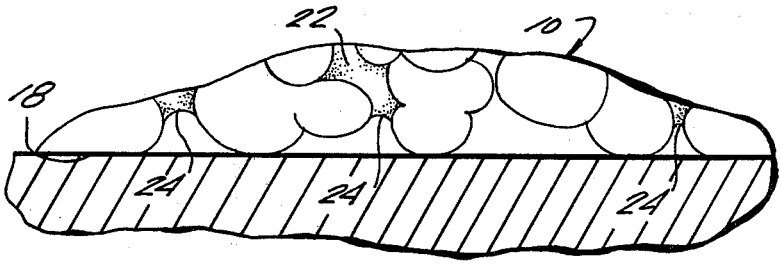
Fig. 2
Fig. 3
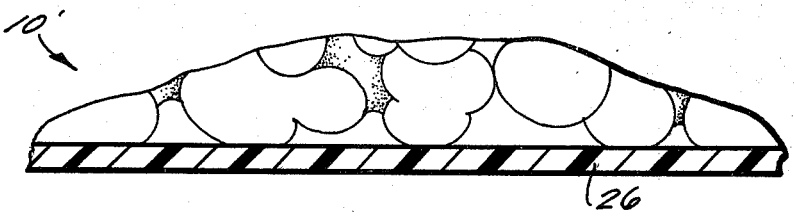
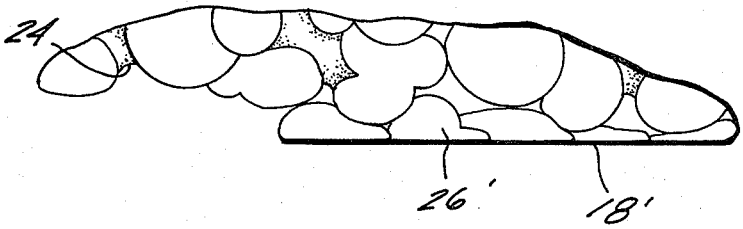
Fig. 4

DRINK COASTERS

BACKGROUND OF THE INVENTION

This invention relates to coasters for drink containers.

Coasters for drink containers have been well known and widely used for some time, their function being to prevent spillage or condensation liquid from the sides of the container reaching the surface of the table. Most commonly used coasters perform this function entirely adequately in conditions where condensation and spillage are low or medium, but where heavy condensation or spillage occur, they cannot cope with the excessive liquid which then flows on to the surface of the table. It is possible to make coasters in the form of miniature trays which are capable of holding any quantity of condensation or spillage, but this then means that the liquid remains permanently in the bottom of the coaster and drips from the bottom of the drink container every time the drink container is raised.

SUMMARY OF THE INVENTION

The present invention provides a coaster which overcomes these problems.

In particular, the present invention provides a coaster for a drink container characterized in that the coaster incorporates a microporous structure capable of absorbing liquids which fall upon the surface thereof. Such a coaster, provided it is of appropriate dimensions and porosity, can prevent any spillage or condensation from reaching the table surface, yet will remain externally dry.

The principles of the invention will be further discussed with reference to the drawing wherein a preferred embodiment is shown. The specifics illustrated in the drawings are intended to exemplify, rather than limit, aspects of the invention as defined in the claims.

BRIEF DESCRIPTION OF THE DRAWING

In the drawing:

FIG. 1 is a perspective view of a drink resting on a coaster provided in accordance with principles of the present invention;

FIG. 2 is a simplified, greatly-enlarged fragmentary side elevation view of a lower edge portion of the coaster of FIG. 1;

FIG. 3 is a view similar to FIG. 2, but of a second embodiment; and

FIG. 4 is a view similar to FIGS. 2 and 3, but of a third embodiment.

DETAILED DESCRIPTION

The coaster 10 may be made from any convenient metallic material which can be endowed with the necessary microporous structure.

The coasters produced from powdered metals can be made to a high standard of finish and these are my preferred starting materials. The metals used to prepare suitable coasters are those which can be worked into articles by powder metallurgy. The process of producing an article from a metal powder is a two stage one, (a) the powder is loaded into a die and pressed to give an article of the correct shape—this results in what is known as a "green" article, and, (b) the "green" article is sintered in a furnace. The porosity of the final coaster is inversely proportional to the density of the metal compact and this is directly proportional to the pressure exerted at the pressing stage. The coaster is at its most fragile at the "green" stage, and although a lower applied pressure will give a higher porosity (and therefore a higher absorptivity), the "green" coaster must be capable of withstanding the rigours of handling prior to sintering, and this requirement places an effective upper limit on the achievable porosity. This will differ from material to material, but in the case of iron, 4.3 gm $cm^{-3}$ is the lowest tolerable compact density. On the other hand, high pressures will produce very tough "green" coasters, but these may have unacceptably low porosities (and therefore absorptivities). Taking again the example of iron, the upper acceptable density limit is 6.2 gm $cm^{-3}$. The preferred density range for iron compacts for purposes of the invention is 5.0–5.2 gm $cm^{-3}$. A person skilled in the art can readily work out suitable parameters for any given metal powder. If a polished die is used, coasters of a very high quality and excellent appearance can be produced.

Coasters prepared according to my invention will have the previously stated advantage that they can absorb normal spillage and condensation from a drink container. Such a coaster will dry-out of its own accord if left in the atmosphere and will be ready for use again. This process may be accelerated by placing the coasters in a warm atmosphere, or, in the case of entire metal coasters, by gently heating in an oven. If a liquid which leaves an undesirable solid residue, for example, milk, is spilled on a coaster according to the invention, it can be removed by immersing the coaster in water containing a suitable detergent and then permitting it to dry in air.

The invention is further illustrated by the following example.

EXAMPLE

Iron powder was loaded into a die which was designed to produce discs of 7 cm diameter and compressed in a hydraulic press such that the material of the disc had a density of 5.0 gm $cm^{-3}$. The resulting disc was sintered in an oven for 1½ hours at 1120° C. The sintered disc was suitable for use as a coaster 10 and could easily absorb the condensation 12 from a cold drink container 14 in a hot humid environment and still remain apparently dry on the surfaces 16 and 18.

The following is a further discussion particularly relating to the microporous coaster when made, as preferred, by compressing and sintering a metal powder.

The coaster of the present invention when made of metal preferably is made of microporous stainless steel. However, the other metals which may be made into powder compacts and sintered, yet remain microporous may be used. For instance, the coaster may be made of pewter, bronze or brass.

An important motivating factor in bringing forth the present invention is to provide a drink coaster which looks elegant enough for formal use, but which need not be so precious as some nor so useless as most presently made for this purpose.

At present silver plated coasters of various designs are available, however none are absorbent. Although they successfully protect table/tablecloth they do not prevent spillage/condensation dropping from the wet bottom of the glass on to the drinker's lap.

The upper sides of some prior art silver plated coasters are stamped with scroll-work or other designs during manufacture. It is within the capability of the methods for producing the coasters of the invention to pattern the upper and/or the lower surfaces of the coasters in raised or base relief, for instance to provide decorative designs, channels for moisture being absorbed and/or feet.

These patterns may be far more dramatic in function and/or appearance by having relief features with a greater height or depth than conventionally is provided on stamped and plated metal coasters.

Typically when manufacturing a coaster of the present invention, using powdered metal, a conventional press is used which, in simple terms, includes a die, a top punch and a bottom punch. The latter punch is usually fixed, with the top one connected to the hydraulic or mechanical ram. A design may be cut into the top punch which will be transferred onto the powder on compression. Additionally, since the method for making the coaster of a powder, one could give the entire coaster any shape one chose, and any pattern, relief, imprint or embossment one chose; e.g. instead of surface scroll work as at 20, one could cut the top punch into a series of 3 mm high pyramids to produce a comparable series of pyramids on the coaster.

The present inventor has made a capacity comparison of the preferred microporous metal coaster of his invention, with certain prior art coasters made of other materials. In the course of conducting such testing the present inventor has come to some conclusions about desired size and bulk for the coasters. These test results and conclusions are first summarized below, then supported by additional test information.

A typical microporous metal coaster of the present invention would be:

| | | |
|---|---|---|
| 70 mm diameter<br>5 mm thick | } volume 19–23 ccs. | |
| Capacity of coasters (theoretical): | | |
| Density 5 g/cc | Capacity 7.00 cc | % porosity 36% |
| Density 5.2 g/cc | Capacity 6.51 cc | % porosity 34% |

Practical experimentation has shown that the porosity averages between 27–30%. This means the coasters will retain 5–6 cc of fluid without leakage or surface wetting.

Comparable figures of other materials are:

| | |
|---|---|
| Paper (blotting paper type) | capacity 0.6 cc % porosity 44% |
| Cardboard (a) | capacity 6.48 cc % porosity 53% |
| Cardboard (b) | capacity 12.45 cc % porosity 67% |
| Cork | capacity .23 cc % porosity 0.01% |

In the case of the cardboard/paper and natural fibre coasters, they all expanded considerably when saturated. Figures given are wet porosity since the dry dimensions are irrelevant. In the case of the paper coaster, using the dry dimensions the % porosity worked out to be 103% which is meaningless.

The cork seemed to be water resistant and numerous types were tested, without weighing, to see if they absorbed water, but all were the same as above. The water simply sat on top of the cork as it would on glass.

The present inventor has been unable to locate any unglazed pottery coasters, however he did try placing small drops of water on earthenware pots. The rate of absorption was extremely slow, taking some 5–10 minutes.

In all cases with the natural materials the saturation point was taken when the coaster ceased to increase in weight yet had no excess water on the surfaces.

The present inventor found that the microporous metal coasters of the present invention were able to absorb up to 27%–30% without showing signs of wetness, though they do darken in colour. Unlike natural fibre and paper/cardboard types the metal does not become "damp". Paper/cardboard types become wet to the touch very quickly but the metal does not. FIG. 2 best illustrates why. FIG. 2 is a simplified, greatly-enlarged fragmentary side elevation view of a lower edge portion of the coaster of FIG. 1.

Even though the fluid 22 spreads evenly throughout the coaster 10 a surface film or damp feeling does not develop because of the meniscus effect shown at 24. Wet film will not form until the coaster 10 is saturated.

The product could include a smooth impermeable base to avoid wicking and present a smooth surface to preclude scratching tables.

Further Details of Comparisons

| | | | |
|---|---|---|---|
| PAPER (Blotting) | | | |
| Dry: | Weight | 2.916 g | |
| | Length | 20 cm | |
| | Width | 15.2 cm | |
| | Thickness | 0.015 cm | |
| | Volume | 4.56 $cm^3$ | |
| Wet: | Weight | 7.635 g | |
| | Thickness | 0.035 cm | |
| | Thickness increase | 0.02 cm (150%) | |
| | Volume | 10.64 cm | |
| Wet weight – Dry weight | = 4.719 g | = Vol. of water absorp. | = 4.719% |
| Wet % Porosity | = 4.72 / = 10.64 | = 44.35% | |
| 7 cm Circular disc. | | = Wet volume - 1.35 cc<br>Capacity - 0.6 cc | |
| CARDBOARD (a) | | | |
| Dry: | Weight | 6.997 g | |
| | Diameter | 10 cm | |
| | Thickness | 0.1 cm | |
| Wet: | Weight | 13.472 | |
| | Thickness | 0.155 cm | |
| | Volume | 12.17 $cm^3$ | |
| Wet Weight – Dry weight | | = 6.475 g | |
| Wet % Porosity | | = 53.2% | |
| CARDBOARD (b) | | | |
| Dry: | Weight | 5.132 g | |
| | Width/Length | 9.3 cm | |
| | Radii | 1 cm | |
| | Thickness | 0.17 cm | |
| Wet: | Weight | 17.578 g | |
| | Thickness | 0.215 cm | |
| | Volume | 18.59 $cm^3$ | |
| Wet weight – Dry weight | | = 12.446 | |
| Wet % Porosity | | = 66.95% | |
| CORK | | | |
| Dry: | Weight | 8.349 g | |
| | Diameter | 7.2 cm | |
| | Thickness | 0.55 cm | |
| | Volume | 22.38 $cm^3$ | |
| Wet: | Weight | 8.575 g | |
| Wet weight – Dry weight | | = 0.226 | |
| % Porosity | | = 0.01% | |
| FIBRE | | | |
| Dry: | Weight | 7.1 g | |
| | Diameter | 9 cm | |
| | Thickness | 0.35 cm | |
| Wet: | Weight | 17.34 g | |
| | Thickness | 0.4 cm | |
| Wet weight – Dry weight | | = 10.24 | |
| Wet Volume | | = 25.43 $cm^3$ | |
| Wet % Porosity | | = 40.26% | |

-continued

| | | |
|---|---|---|
| METAL (microporous) | | |
| Depth | 0.5 cm | Pure Solid Iron: |
| Diameter | 7 cm | Density 7.86 g/cc |
| Volume | 19.23 $cm^3$ | Volume 19.23 $cm^3$ |
| | | Weight 151.15 g |
| Coaster (i) | | |
| Density | | 5.00 g/cc |
| Volume | | 19.23 $cm^3$ |
| Weight | | 96.15 g |
| Volume Air | | $\times \frac{151.15 - 96.15}{7.86}$ |
| | | = 7.00 $cm^3$ |
| Theoretical % Porosity | | = 36.4% |
| Coaster (ii) | | |
| Density | | 5.2 g/$cm^3$ |
| Weight | | 100 g |
| Liquid Capacity | | = 6.51 cc |
| Theoretical % Porosity | | = 33.85% |
| Practical Experimentation Porosity | | = 27–30% |
| (Prac. Porosity 30% 5.0 g/$cm^3$) Capacity | | = 5.77 g/$cm^3$ |
| (Prac. Porosity 27% 5.2 g/$cm^3$) Capacity | | = 5.19 g/$cm^3$ |

In FIG. 3 this has been shown done by adhering or laminating a layer of impermeable material 26 on the underside 18 of the sintered metal disk portion 10' of the coaster. This layer 26 may be made of metal, cork, rubber or the like. In FIG. 4, this has been shown done by post-working the coaster lower surface at 18' e.g. by burnishing, to close the voids in this area, to produce in situ out of the metallic material of the sintered compact itself, and physically one therewith, an integral, but substantially impervious to liquid, lower skin 18'.

In the FIG. 3 embodiment the separate layer 26 is shown being coextensive with the underside of the disk 10', whereas in the FIG. 4 embodiment the integral layer 26' is provided as each of preferably several laterally discontinuously provided feet 26'. However these techniques are interchangeable, in that the separate layer could be provided as several discrete feet, or the integral layer could be provided over the whole of the underside of the coaster.

The physical principles of capillarity are the same for all absorbent coasters. However the macrostructure of metal coasters is significantly different from that of all other absorbent coasters mentioned barring earthenware. Paper is a random arrangement of short fibres chemically bonded together. Cardboard is essentially layers of paper compressed together. Woven coasters are longitudinally arranged bunches of fibres that are not chemically bonded as paper. All the above form a microporous structure i.e. a structure that is loosely connected and has a whole series of voids.

Microporous metal coasters do not have any fibres. A reasonably accurate simplification is to treat all granules of the powdered metal as spheres and these are randomly arranged with bonding at a number of points around each sphere. Naturally voids form in between the spheres. The bonding is a combination of cold forging, which holds the "green" product together, and the welding which results from the heating of the product.

As far as porous earthenware is concerned the macrostructures would be similar except the metal coaster would be far coarser in structure and appearance; e.g. on a partly polished microporous metal surface of prescribed density the pores or voids are visible to the naked eye, or in unpolished condition, visible under low magnification (×15). The same cannot be said for any type of unglazed earthenware. The metal's porous structure is visible as an even arrangement of very fine pores over the surface of the metal.

The most common coaster which is the cardboard/paper type, along with natural fibre types, have one other distinctive characteristic. They expand to some degree when absorbing water. The cardboard/paper types expanded 50–150% on their original dry thickness. There was no significant increase in length, width or diameter. They are also unattractive, deteriorate and discolour.

Microporous metal coasters are unique in that they will absorb liquid, can be cleaned, oven dried, dried naturally, are attractive and durable. They do not expand when absorbing liquid. The macrostructure, material and manufacturing process has no comparison.

It should now be apparent that the drink coasters as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A drink coaster, comprising:

a disk of microporous metal constituted by a sintered compact of metal powder having a porosity of about 27–30 percent, and having a lower face including at least one portion comprising support surface means by which said coaster may be supported on a table top, said support surface means being constituted by a substantially drink liquid-impervious layer of said metal formed in situ on said sintered compact as an integral feature which is physically at one therewith.

2. The coaster of claim 1, wherein:

said metal is stainless steel.

3. The coaster of claim 1, wherein:

said at least one portion is substantially coextensive with said lower face.

4. The coaster of claim 1, wherein:

said at least one portion is constituted by a plurality of such portions, said portions being provided in the form of respective discrete, depending foot means provided on said lower face.

5. The coaster of claim 1 having surface relief integrally formed in an upper face thereof creating a visually apparent three-dimensional design.

* * * * *